US005445461A

United States Patent [19]

De Roeck et al.

[11] Patent Number: 5,445,461

[45] Date of Patent: Aug. 29, 1995

[54] DETACHABLE CARRIAGE DRIVE

[76] Inventors: Jozef De Roeck; Eduard V. Vaeck, both of c/o Agfa-Gevaert N.V., Sepestraat 27; Marc Sillis, 46, c/o Agfa-Gevaert N.V., Septestraat 27; Michel Marckx; Paul Van Hecke, both of c/o Agfa-Gevaert N.V., Septestraat 27, all of B 2640 Mortsel, Belgium

[21] Appl. No.: 165,820

[22] Filed: Dec. 14, 1993

[30] Foreign Application Priority Data

Jan. 8, 1993 [EP] European Pat. Off. ..... 93200042

[51] Int. Cl.[6] ..... B41J 19/18

[52] U.S. Cl. ..... 400/322; 400/328; 74/37

[58] Field of Search ..... 400/320, 322, 328; 74/37

[56] References Cited

U.S. PATENT DOCUMENTS

| | | | |
|---|---|---|---|
| 3,739,899 | 6/1973 | Brumbaugh et al. | 400/322 |
| 3,805,699 | 4/1974 | Mallofre | 101/123 |
| 4,277,189 | 7/1981 | Howard et al. | 400/328 |
| 4,412,704 | 11/1983 | Gagnebin | 400/328 |
| 4,459,054 | 7/1984 | Dollenmayer | 400/320 |
| 4,613,246 | 9/1986 | Sugiura et al. | 400/320 |
| 4,883,445 | 11/1989 | Gomoll et al. | 400/320 |
| 5,044,797 | 9/1991 | Walker et al. | 400/320 |

*Primary Examiner*—Edgar S. Burr
*Assistant Examiner*—John S. Hilten
*Attorney, Agent, or Firm*—William J. Daniel

[57] ABSTRACT

A carriage, preferably carrying a knife for cutting a moving web for attachment of the cut web end to a web winding roll, is driven on a supporting rail along a linear path by means of a driving motor operating a toothed driving belt. The belt is detachably clamped to the carriage by a clamp fixed on the carriage and formed by a support plate having a belt supporting surface thereon and a pressure plate provided with teeth for mating engagement with the belt teeth mounted on the support plate in opposed relation to the support plate surface to define with the surface a slot for reception of the belt. The pressure plate is slidably supported for movement toward and away from the surface and is spring-biased to normally clamp the belt therebetween. Emergency stop means are effective if the carriage due to accident should exceed the normal end limits of its path to lift the pressure plate against the spring-bias away from the belt supporting surface and disengage the belt from the camp, allowing the carriage to be arrested by a shock absorber disposed adjacent each end of its path.

7 Claims, 2 Drawing Sheets

DETACHABLE CARRIAGE DRIVE

BACKGROUND OF THE INVENTION

1. Field of the Invention

This invention relates to a device for clamping a movable carriage to a moving drive belt. It is particularly concerned with providing secure clamping to a movable drive belt of a component which is required to make movements involving rapid acceleration and/or retardation 2. Description of the prior art A specific need for such secure clamping arises in the transverse cutting of a high speed web of photographic material, for example as it emerges for rewinding after passage through a line in which it is coated with photosensitive material. Our European patent application 93 200043.3 filed on Jan. 8, 1993 and entitled "Web cutting device", relates to a cutting device for this purpose wherein a movable cutting head must be securely attached to an endless loop drive belt. The clamp of the present invention is especially well suited to use with the device of the said copending application and is primarily described herein with reference thereto.

A typical automated arrangement for rewinding of a web of photographic material comprises a turret including a rotatable holder for two cores. Winding commences on a first empty core and continues until a full roll has been wound. As the winding approaches the full-roll stage, the holder moves a second empty core towards and close to, but still out of contact with, the path of travel of the web upstream of the filling core. When the latter core is fully wound the web is cut close to the empty core. The new leading edge of the web is brought-into contact with the empty core for attachment thereto, normally with the assistance of a pre-applied adhesive strip on the core surface. The full roll is then removed from the holder and replaced by a new empty core.

The device of our said co-pending patent application comprises a frame with a fixed track, a fixed driving bar and a motor-driven belt, all of which extend across and beyond the path of the web, and further comprises a movable carriage which incorporates a drive wheel rotatable by contact with the fixed driving bar to drive a web-cutting blade. Because most of the components required to drive the cutting blade are accommodated on the frame, the carriage is of simple and lightweight construction such that it can be accelerated from rest to the desired cutting speed within a region of the frame situated beyond one edge of the web, i.e. outside the point at which the blade contacts the web. The blade traverses the web at a fast and uniform cutting speed which ensures the required clean cut and is then retarded to rest after the cut is complete, the retardation being also accomplished within a section of the frame beyond the other edge of the web.

In a typical web turret, however, the available space beyond the width of the web is severely limited and the acceleration and retardation must therefore be accomplished in a short lateral distance, typically in the range 300 to 400 mm. The required acceleration and retardation of the carriage in the available space must therefore be very high, for example up to 15 G. A fixed coupling arrangement, such as a carriage bolted to a driving belt, would suffer from the disadvantage that if for any reason, for example failure of the electronic control circuit or motor defect, the carriage is not decelerated within the available distance, the carriage would strike the machine frame and become damaged or destroyed.

SUMMARY OF THE INVENTION

Object(s) of the Invention

It is thus an object of the present invention to provide a clamping device for securely clamping a movable carriage to a moving drive belt, which provides the advantage of combining firm attachment to a drive belt with easy and quick releasability.

Statement of Invention

According to a first aspect of the present invention there is provided a clamping device for attachment of a transversely toothed drive belt to a belt support plate on a movable carriage, characterised in that the belt support plate houses a movable bar carrying a pressure plate biased to press the drive belt against the support plate, in that at least one of the support plate and pressure plate have a toothed surface to receive the teeth of the drive belt and in that the device includes means for cooperating with limit of travel means for disengaging the clamping device from the drive belt.

The clamping device of the invention provides the advantage of combining secure attachment to a drive belt with easy and quick releasability. Slippage of the clamp on the belt in the direction of belt travel is prevented by the engagement of the teeth on the drive belt with the teeth on the pressure plate. Continuous engagement of the said teeth is ensured by the bias of the pressure plate towards the support plate.

In general the drive belt, for example a commonly used timing belt, has teeth on one side only. The choice of which of the plates includes a toothed surface to mesh with the teeth of the drive belt is determined primarily by the specific alignment of the belt. If desired, both surfaces can be toothed so as to make possible alternative alignments of the clamp and belt or the use of a drive belt with teeth on both sides.

In order to ensure that slippage of the belt in a direction at right angles to its travel cannot occur, one or both of the plates also desirably includes longitudinal teeth or stops spaced apart by a distance equal to the width of the belt.

The pressure plate and the support plate respectively form the Jaws of the clamping device, and these jaws ideally have generally parallel surfaces which engage the drive belt. The movable jaw bar is preferably arranged so as to be slidable: within the support plate. This keeps the jaws of the clamp parallel to each other upon opening, and produces a quicker release than if the moveable jaw were pivoted. The sliding is preferably enhanced by the use of roller-bearings or ball-bearings.

The bias of the plates towards each other is conveniently achieved by one or more springs. For most applications a coil spring is preferred, care being taken to provide suitable securing points for the respective spring ends. The spring pressure is preferably selected to be sufficient to hold the belt firmly in place during acceleration and deceleration while not rendering separation of the plates unduly difficult.

According to a second aspect of the invention, there is provided an assembly comprising the clamping device associated with a web-winding turret frame which supports the drive belt and means for driving the drive belt, said limit of travel means being mounted at a chosen point on the web-winding turret frame so as to disengage the clamping device from the drive belt at that point.

In a preferred embodiment of the invention, the limit of travel means comprises a guide plate which is fixed relative to the web-winding turret frame and is engagable by a tongue carried on the clamping device, so as to move the pressure plate out of engagement with the drive belt and thus allow the carriage to stop.

This quick releasability is a major advantage of the present invention. If for any reason, for example failure of an electronic control circuit or motor defect, the carriage is not decelerated within the available distance, the carriage will be released from the drive belt, enabling the striking of the carriage against the machine frame to be avoided. The release of the carriage from the drive belt may not, by itself, be sufficient to stop the movement of the carriage, However, this can be achieved, according to a preferred embodiment of the invention, by arranging for the carriage in this situation to abut a device, such as a hydraulic damper, positioned on the web-winding turret frame, to stop the carriage without damage following disengagement of the clamping device from the drive belt, by absorbing the kinetic energy of the moving carriage.

The tongue and guide plate preferably have cooperating configurations. The tongue is preferably wedge shaped in the direction of travel of the carriage, with the thin end of the wedge in the leading position, and the guide plate can conveniently be provided with means, such as a roller bearing or ball bearing, to facilitate the disengagement.

BRIEF DESCRIPTION OF THE DRAWINGS

The invention is further described herein with reference to the accompanying drawings, in which.

DETAILED DESCRIPTION OF THE INVENTION

Figure 1:
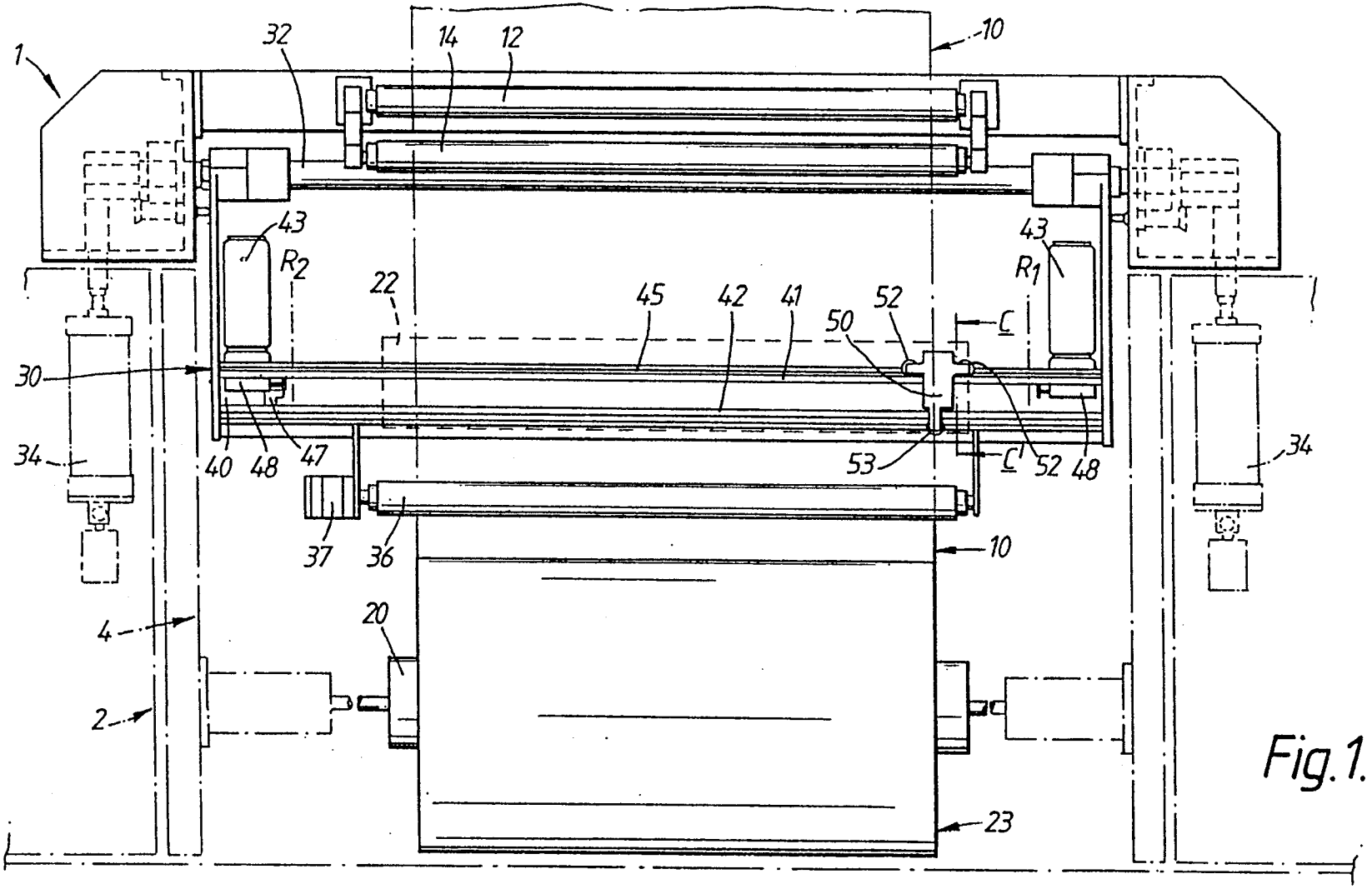
FIG. 1 is a general view of a web rewinding turret and a movable cutting carriage thereon.

The web rewinding turret 1 comprises a support structure 2 (indicated by dotted lines) which carries a centrally pivoted holder 4 (also indicated by dotted lines) with winding cores 20 and 22 at the ends remote from its pivot point. The cores are driven by motors (not shown).

The turret 1 receives web material 10 advancing from a photographic coating line (not shown) and which passes over guide rollers 12 and 14 to reach the respective winding core.

Figure 2:
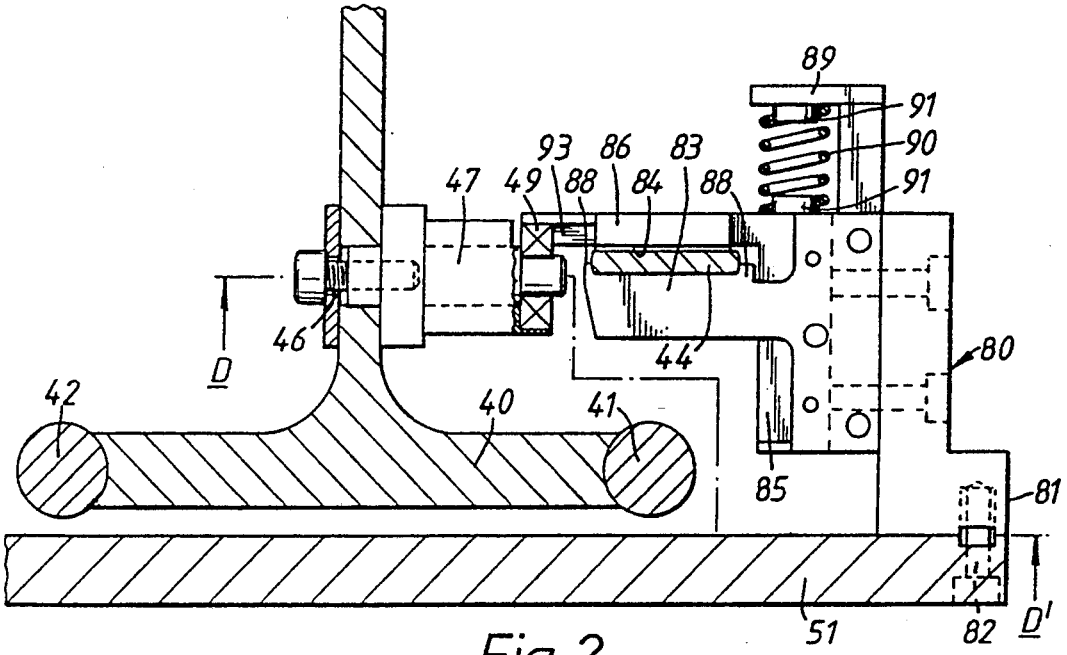
FIG. 2 is a sectional side view, on a larger scale than FIG. 1, of one version of clamp according to the invention and mounted on the cutting carriage, as-seen with respect to the carriage from line C–C′ on FIG. 1 but as seen with respect to the turret with the carriage just beyond the end point of its travel indicated by line $R_2$ on FIG. 1.
Figure 3:
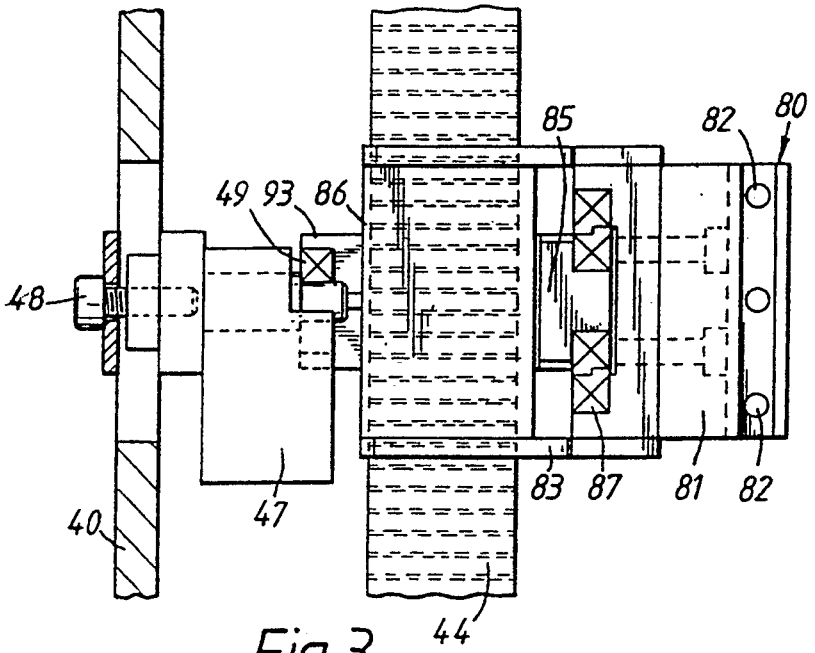
FIG. 3 is a view of the underside of the clamp, as seen along line D–D′ on FIG. 2.

The support 2 also carries an axle 32 on which is mounted a frame 30, powered by pneumatic pistons 34. FIG. 1 shows the frame 30 in its web-cutting position at the point of time at which a full roll 23 has been wound on the core 20 and the web is about to be cut and secured to the empty core 22. The frame 30 carries a guide roller 36, with an associated drive motor 37. In the web-cutting position the guide roller 36 bears against the web 10 to hold it close to the empty core 22 across the full web width. The frame 30 also carries a transverse beam 40 Which comprises guide bars 41 and 42 for a movable carriage 50. Drive motors 43, one at each end of the beam 40, power an endless-loop ribbed drive belt 44 (not seen in FIG. 1) to which the carriage 50 is attached by a clamp 80 according to the invention (FIGS. 2 and 3). A fixed bar 45 which incorporates a grooved rack is also attached to and extends across the full width of the frame 30.

The carriage 50 has a base plate 51 and two upper pulleys 52 and a lower pulley 53, the said pulleys running on respectively the upper and lower guide bars 41 and 42. It also includes, as illustrated and described in greater detail in our aforementioned co-pending application, a web-outting head and pinions which take up a drive for the head from the movement of the carriage 50 across the racked bar 45. The pre-cutting rest position of the carriage 50 is indicated in FIG. 1 by the line $R_1$ and the post-cutting rest position by the line $R_2$, these positions being defined by a pair of hydraulic dampers 48, secured to the beam 40. Lines $R_1$ and $R_2$ thus show limits of the path of the carriage 50 from rest to rest and emphasize the short lateral distances along that path between $R_1$ and $R_2$ and the respective edges of the web 10 in which the carriage 50 must be accelerated to, and retarded from, the required optimum cutting speed.

As can be seen in FIGS. 2 and 3, the clamp 80 includes a support arm 81 which is secured to the base plate 51 of the carriage by bolts 82. The support arm 81 carries a support plate 83 which fulfils several purposes: it receives the drive belt 44; it houses a movable bar 85, which is slidable within a groove provided in the plate 83 on roller bearings 87; and carries a pressure plate 86 to bear against the drive belt 44; and it carries a fixed arm 89 to provide the base for a coil spring 90. The coil spring 90 is thus disposed between the fixed arm 89 and the pressure plate 86 and is held in place at its ends by securing studs 91 on the fixed arm 89 and the pressure plate 86 respectively, thereby providing a biasing force to hold the pressure plate 86 against the drive belt 44.

The pressure plate 86 has transverse teeth 84 on the inner surface thereof to receive the teeth of the drive belt 44. It further incorporates a tongue 93 which extends beyond the width of the drive belt 44. The tongue 93 is wedge-shaped with the thin end of the wedge at the outer or leading side of tongue 93, i.e. upwardly, as viewed in FIG. 3. The beam 40 carries a cooperating fixed plate 47, held to the beam for limited lengthwise adjustment along the beam by a securing bolt 46, and having a ball bearing unit 49 at its leading edge.

In normal operation the clamp is constantly engaged with the drive belt 44 under the action of the spring 90 forcing the pressure plate 86 toward the support plate 83. In this condition the teeth of the belt 44 are firmly meshed in the corresponding teeth 84 of the support plate surface and can easily withstand the large acceleration and retardation forces imposed on the carriage 50 during its web-cutting pass.

A web-cutting traverse by the carriage is automatically triggered when the core 20 reaches its fully wound dimension 23. The carriage 50 accelerates from position $R_1$to its cutting speed, moves across the web uniformly at that speed and then is retarded to come to rest at $R_2$. The speed profile of the carriage from rest to rest position is controlled by the motors 43 and transmitted to the carriage 50 through the drive belt 44.

In the event of equipment failure in which the retardation of the carriage 50 does not occur within the defined distance up to $R_2$, the tongue extension 93 of the pressure plate 86 engages the roller bearing 49 on the beam plate 47. The pressure plate is thereby lifted away from the drive belt 44 against the pressure of the spring 90 and the drive belt is disengaged from the clamp. The carriage 50 thus strikes against the adjacent damper 48 and comes to rest without causing damage to any of the frame or carriage components.

We claim:

1. A detachable carriage drive comprises a carriage movable in a linear path along a supporting rail, a driving belt for driving said carriage along said path, said driving belt having teeth on one side thereof, motor means for advancing said driving belt in opposite directions along said path, and clamping means carried by said carriage for deteachably attaching said carriage to said driving belt, said clamping means comprising a belt support plate fixed on said carriage and carrying a belt contacting surface proximate to one side of said belt, a pressure plate mounted on said belt support plate generally opposite and parallel to said belt contacting surface to define a slot therebetween for reception of said belt, said pressure plate being supported for bodily movement toward and away from said belt contacting surface and having teeth thereon for mating with the driving belt teeth, and means normally biasing said pressure plate toward said supporting plate for clamping engagement of the driving belt therebetween with the plate teeth meshing with the driving belt teeth to thereby attach the carriage to said belt, said pressure plate being movable against said biasing means to disengage the teeth thereon from said driving belt teeth to detach said carriage from said driving belt.

2. The carriage drive of claim 1 wherein said carriage is driven by said motor means along said linear path between two normal end points and including emergency carriage stop means for detaching the carriage from said driving belt in the event of accidental failure of said motor means to stop said carriage at one of said normal end points, said stop means comprising cam and guide means, one of said cam and guide means being fixed on said rail at a point proximate to but outside the normal end point of said path and the other carried by said carriage, said cam and guide means engaging in the event the carriage moves past said normal end point and cooperating to move said pressure plate against said biasing means to disengage the plate teeth from said driving belt teeth and thereby detach the carriage from the driving belt.

3. The carriage drive of claim 2, including shock absorbing means outside the path end points for impact by the carriage upon detachment thereof from said driving belt.

4. The carriage drive of claim 2 wherein said cam and guide means comprising an inclined cam surface projecting from said pressure plate and a roller fixed on said rail outside a normal end point of said path for engagement by said inclined cam surface.

5. The carriage drive of claim 1 wherein said support plate has a groove therein extending perpendicular to the surface thereof and said pressure plate is carried at an end of a bar sliding in said groove.

6. The carriage drive of claim 5 wherein said biasing means comprises a compression spring acting against an end of said bar to urge the same in a direction moving said pressure plate toward said support plate surface.

7. The carriage drive of claim 1 wherein said driving belt is formed as a endless loop and is driven by said motor means back and forth along said linear path.

* * * * *